US008919275B2

(12) United States Patent
Hinson

(10) Patent No.: US 8,919,275 B2
(45) Date of Patent: Dec. 30, 2014

(54) FLEXING LEANING POST AND COMPONENTS FOR MODIFYING LEANING POSTS TO FLEX

(71) Applicant: Robert Hinson, San Antonio, TX (US)

(72) Inventor: Robert Hinson, San Antonio, TX (US)

( * ) Notice: Subject to any disclaimer, the term of this patent is extended or adjusted under 35 U.S.C. 154(b) by 169 days.

(21) Appl. No.: 13/847,270

(22) Filed: Mar. 19, 2013

(65) Prior Publication Data

US 2013/0312653 A1 Nov. 28, 2013

Related U.S. Application Data

(60) Provisional application No. 61/652,056, filed on May 25, 2012.

(51) Int. Cl.
*B63B 17/00* (2006.01)
*B63B 29/04* (2006.01)

(52) U.S. Cl.
CPC ..... *B63B 17/00* (2013.01); *B63B 29/04* (2013.01); *B63B 2029/043* (2013.01); *B63B 2221/22* (2013.01)
USPC ..... 114/363; 297/188.2; 297/452.2

(58) Field of Classification Search
CPC .. B63B 29/04; B63B 2029/043; B63B 35/731
USPC ..... 114/363; 297/188.2, 257, 452.2
See application file for complete search history.

(56) References Cited

U.S. PATENT DOCUMENTS

| | | | | |
|---|---|---|---|---|
| 2,478,042 | A * | 8/1949 | Elling | 114/348 |
| 4,566,734 | A * | 1/1986 | Bruner | 297/344.14 |
| 4,700,921 | A * | 10/1987 | Holbrook | 248/421 |
| 4,709,649 | A * | 12/1987 | Wann | 114/363 |
| 4,893,578 | A * | 1/1990 | Doerfer et al. | 114/363 |
| 7,422,279 | B2 * | 9/2008 | Kushner et al. | 297/188.12 |
| 7,647,880 | B2 * | 1/2010 | Devine | 114/363 |
| 7,819,483 | B2 * | 10/2010 | Kushner et al. | 297/452.2 |
| 2009/0188421 | A1 * | 7/2009 | Devine | 114/363 |
| 2013/0312653 | A1 * | 11/2013 | Hinson | 114/363 |

* cited by examiner

*Primary Examiner* — Daniel V Venne
*Assistant Examiner* — Jovon Hayes
(74) *Attorney, Agent, or Firm* — Kammer Browning PLLC

(57) ABSTRACT

A system of components for modifying a watercraft leaning post to provide greater flexibility while maintaining firm support to a boat operator and/or boat passengers. The components include spring modules fitted to the aft side legs of a leaning post, and hinge modules fitted to the forward legs. The top section of the leaning post may then tilt backwards under pressure from the top and/or the bow side. The spring modules are preferably torsion springs configured to fit within a gap created in each of the two aft legs of a four-legged leaning post. The hinge modules positioned within the two forward legs of the leaning post are preferably cylindrical yoke type hinges. The components may be assembled into kit form that includes attachment nuts and bolts that allow modification of an existing leaning post without the need for specialty tools or skills.

20 Claims, 4 Drawing Sheets

FLEXING LEANING POST AND COMPONENTS FOR MODIFYING LEANING POSTS TO FLEX

CROSS REFERENCE TO RELATED APPLICATIONS

This application claims the benefit under Title 35 United States Code §119(e) of U.S. Provisional Application 61/652,056 filed May 25, 2012, the full disclosure of which is incorporated herein by reference.

BACKGROUND OF THE INVENTION

1. Field of the Invention

The present invention relates generally to seating structures for small to mid-sized watercraft. The present invention relates more specifically to modifications to traditional leaning posts used as standing and sitting supports for persons on stationary or moving watercraft.

2. Description of the Related Art

Most small to mid-sized motorized watercraft are fitted with what are commonly known as leaning posts. Leaning posts for boats are typically seat structures that are elevated so as to allow for use not only as seats, but also as back support structures for an individual standing on the deck of the boat. Many situations and conditions require or prefer that boat occupants stand in order to safely and comfortably operate or travel as passengers on the moving watercraft. For the boat operator, leaning posts are frequently positioned on the deck so as to allow the operator to manipulate the controls of the boat while having their back supported to maintain balance, especially when the boat accelerates forward or to the side. Many other situations and conditions on a boat give preference to the occupant standing as opposed to sitting, such as when traveling at low speed over waves or when fishing, where a wider view of the surroundings is required or desired.

Leaning posts have heretofore generally been structured as rigid support devices, although most typically include cushioned seats and/or leaning surfaces. For the most part, the only comfort that traditional leaning posts provide is offered through the thickness and resilient support of the seat cushions and leaning cushions. The frames associated with leaning posts are typically rigid tubular aluminum constructions from 1" to 2" in diameter, with 1¼" and 1½" in diameter being typical. While such frames are typically strong and relatively lightweight, their rigidity adds little to the comfort of the user, especially when the watercraft is traveling through rough water.

It would be desirable to have a leaning post structure that provided greater resilience and therefore greater comfort to the operator and occupants of the watercraft beyond the simple seat cushion or leaning cushion support. It would be desirable to have such a resilient structure incorporated into the frame of a leaning post in a manner that increased comfort and maintained firm support. It would further be desirable if existing leaning post structures could be modified so as to incorporate the components necessary to increase the resiliency and comfort of the leaning post. It would be desirable if the components necessary to modify an existing leaning post could be assembled into kit form in a manner that would allow the average boat owner to easily modify their leaning post without requiring special tools or technical skills for the modification.

SUMMARY OF THE INVENTION

In fulfillment of the above objectives, the present invention provides an array of components suitable for use in an OEM leaning post, or for modifying an existing leaning post, so as to provide greater flexibility to the seating structure, and yet maintain firm support, thereby creating greater comfort to a boat operator and the boat passengers. The components include spring modules that may be fitted to the aft legs of a leaning post, and hinge modules fitted to the forward legs of the leaning post. In this manner, the top section of the leaning post, comprising the top sections of the four legs and the top cushions, may tilt backwards under pressure from the bow side face of the leaning post, such as would be experienced by a boat operator with the boat under acceleration. The spring modules preferably include torsion springs configured to fit within a gap created in each of the aft legs of a four-legged leaning post. The hinge modules positioned within the forward legs of the leaning post are preferably cylindrical yoke type hinges that follow the same lines as the tubular frame components of the leaning post. The components of the invention may be assembled into a kit form that includes attachment bolts and nuts that allow the boat owner to modify an existing leaning post without the need for specialty tools or technical skill. Optional removable covers are provided for aesthetics and for protection of the mechanisms in the spring and hinge modules.

DETAILED DESCRIPTION OF THE PREFERRED EMBODIMENTS

Figure 1:
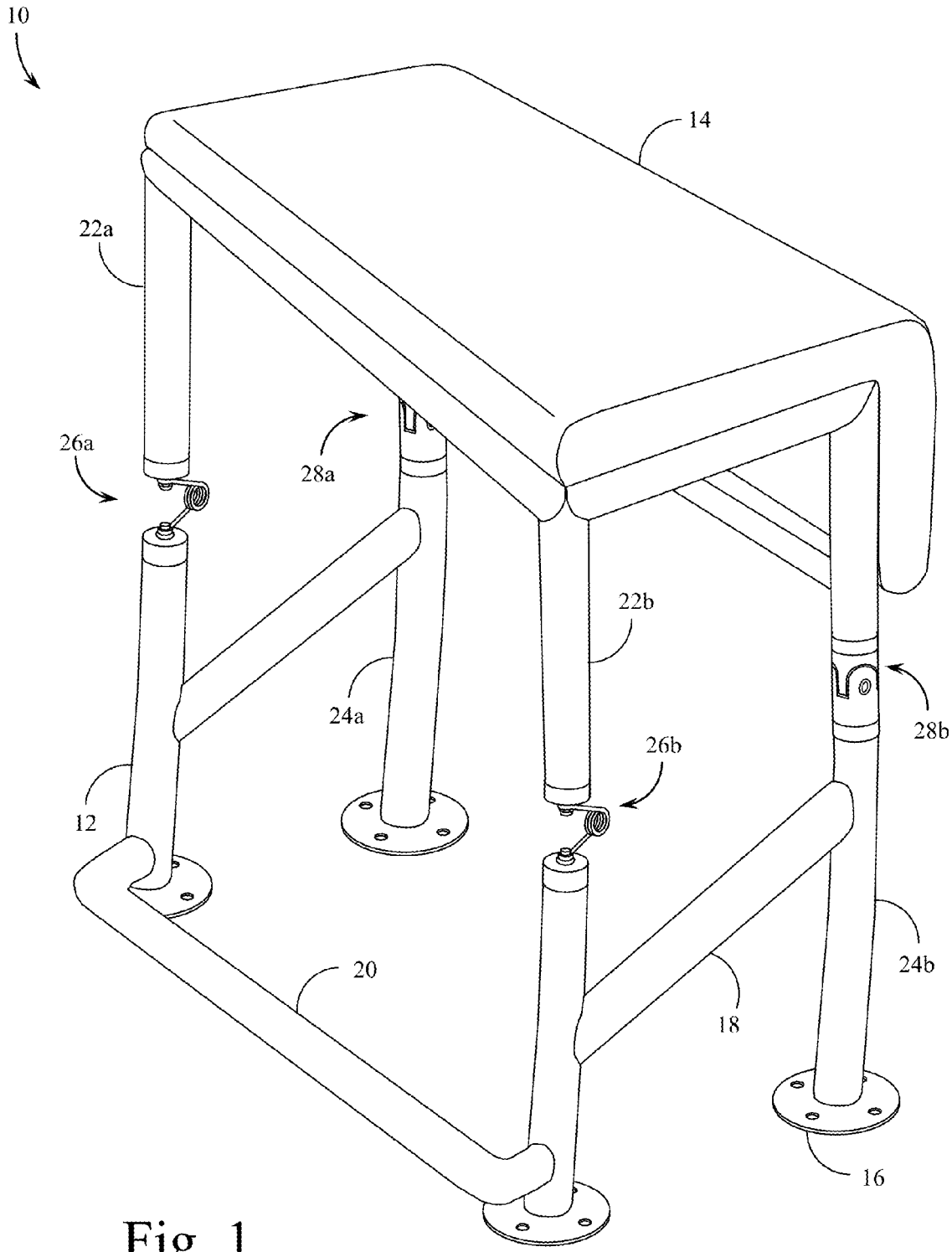
FIG. 1 is a perspective view of a flexing leaning post implementing the components of the system of the present invention.

Reference is made first to FIG. 1 for a detailed description of an implementation of the components of the present invention on a typical leaning post positioned on the deck of a watercraft. Flexing leaning post 10 is shown configured with frame 12 and seat cushion 14. As described above, seat cushion 14 may typically include both a horizontal platform suitable for seating, and a vertical platform directed toward the bow of the boat, suitable for leaning back against. Frame 12 is, as described above, typically constructed from tubular aluminum components that are welded together into a generally rectangular box shaped frame. While there are one and two-legged leaning posts available on the market, the present invention is generally adapted for use in conjunction with four-legged leaning posts, which are the more common construction.

Flexing leaning post 10 is positioned on the deck of a boat and is secured thereto through base flanges 16 positioned at the bottom end of each of the four legs of the leaning post.

Side struts 18 provide necessary frame strength as forces directed forward and aft on the leaning post are the most common. Cross braces such as foot rest 20 are often also included in typical leaning posts, and certainly are present at the top of frame 12 in a manner that supports seat cushion 14.

The implementation of the present invention includes the placement of spring modules on the two aft legs of the leaning post and hinge modules on the two forward legs of the leaning post. In the implementation shown in FIG. 1, port side aft leg 22*a* has been fitted with port side spring module 26*a*. In a similar manner, starboard side aft leg 22*b* has been fitted with starboard side spring module 26*b*. Port side forward leg 24*a* has been fitted with port side hinge module 28*a* and starboard side forward leg 24*b* has been fitted with starboard side hinge module 28*b*.

As shown in FIG. 1, the leaning post implementing the components of the present invention is oriented as is typical for most watercraft. The seat cushion components are, as mentioned above, generally directed forward towards the bow of the boat. The rear of the leaning post is generally directed aft towards the stern of the boat. In the view shown in FIG. 1 the right side of the leaning post (viewed from behind, or aft of the leaning post) is the starboard side of the boat, while the left side of the leaning post is on the port side of the boat. It is understood that these directions are provided as a means of referencing the typical installation of a leaning post and are not limitations on the specific implementation or structure of the components of the present invention. Alternate placement of leaning posts, or similar seating structures on boats, are anticipated. The orientation and arrangement of the components of the present invention is preferably as shown in FIG. 1, primarily due to the fact that it is most often the forward acceleration of a watercraft that requires stabilization for the boat operators and occupants. When slowing, boats typically do not experience abrupt changes in motion and therefore do not experience the abrupt forces that are more commonly experienced with forward acceleration and lateral movement through rough water.

The embodiment shown in FIG. 1 may describe the structure of an original equipment manufacturer (OEM) flexing leaning post. In most cases, however, leaning posts are already positioned and in place on watercraft, such that the complete replacement of a leaning post may be less than desirable. For this reason, the primary implementation of the components and assemblies of the present invention are anticipated to be in conjunction with existing leaning posts and their modification. Because the structures of the components of the present invention lend themselves to easy incorporation into the legs of a typical leaning post, the components will most likely find their preferred implementation in kits to be used in conjunction with the modification of four-legged leaning post structures.

Figure 2:
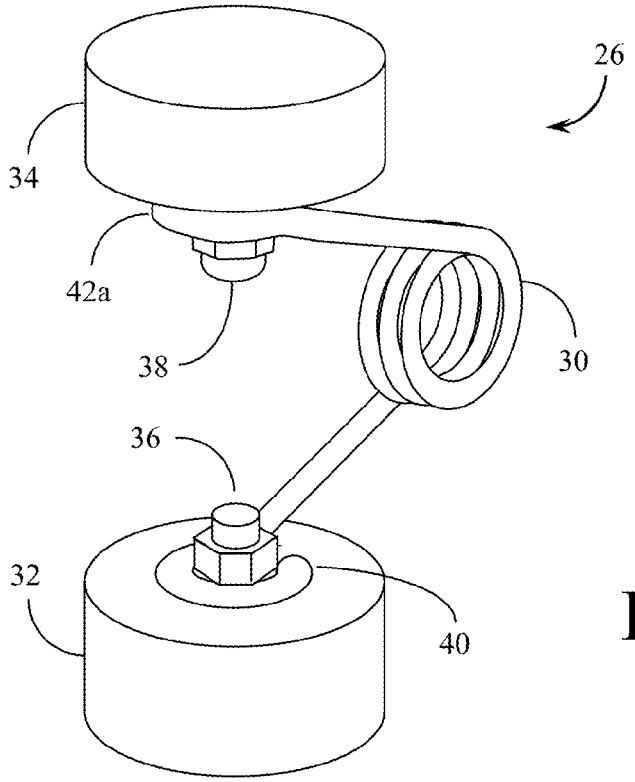
FIG. 2 is a detailed perspective view of the spring module component of the system of the present invention.
Figure 3:
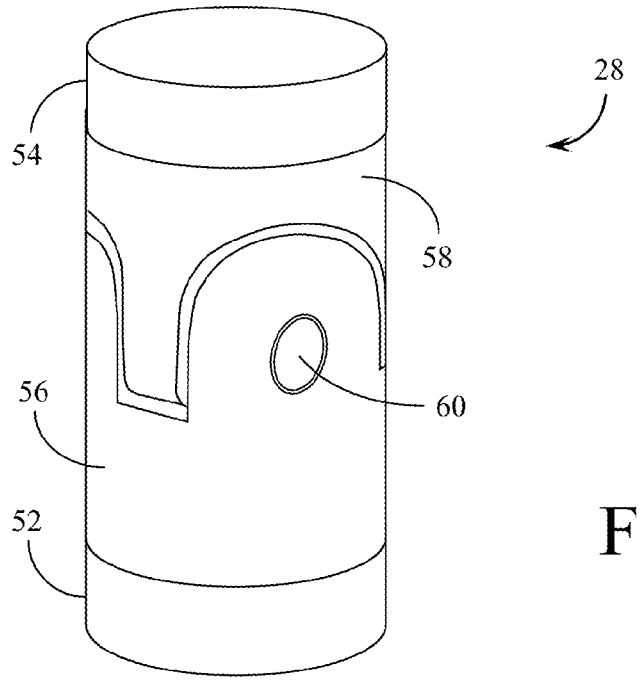
FIG. 3 is a detailed perspective view of the hinge module component of the system of the present invention.

Reference is next made to FIGS. 2 & 3 for detailed descriptions of each of the two different types of modular components provided in conjunction with the assembly of the present invention. FIG. 2 is a detailed perspective view of a typical spring module 26 that is positioned on the aft legs of the leaning post as shown in FIG. 1. Spring module 26 is generally constructed of spring base mount 32 and spring top mount 34, each of which are cylindrical structures designed to attach to the interior ends of the tubular leg section gap that is constructed within each of the two aft legs on the leaning post frame. Various methods for attachment are anticipated for spring base mount 32 and spring top mount 34. Such attachment mechanisms include external cap structures as well as internal plug structures configured for and matching the geometry of the diameter of the cylindrical leg. For leaning post frames constructed of rectangular stock, spring base mount 32 and spring top mount 34 may comprise alternate cap or plug structures shaped to fit the square or rectangular cross-section of the legs.

The spring component of spring module 26 is preferably a helical torsion spring 30 that is sized and strengthened to provide a modest level of flexure under a force typical of that provided by one to two human beings sitting on and/or leaning against the leaning post. The objective is to provide flexibility and resiliency without allowing the gap created in the aft legs to bottom out (fully close). A variety of helical torsion springs are available for such incorporation and use in the assembly of the present invention.

Helical torsion spring 30 terminates in spring top end loop 42 and spring base end loop 40. These loops fit over and around posts and bushings (not shown) extending from spring base mount 32 and spring top mount 34. These posts are preferably threaded on their ends so as to receive and secure spring cap nut 38 and spring cap nut 36. These threaded nuts that are used to secure the spring end loops are preferably capped so as to provide smooth surfaces that may end up being exposed within the gap created in the leg structures.

FIG. 3 is a detailed perspective view of a typical hinge module 28 utilized in the assembly of the present invention. Hinge module 28, like the spring module, includes hinge base mount 52 and hinge top mount 54. Once again, these mounting structures would be configured to accommodate the specific leaning post leg geometries that are being modified.

Hinge module 28 includes hinge yoke post 56 and hinge center post 58, which are hingedly connected together by hinge pin 60 as shown. The orientation of hinge module 28 within the gap created in the forward legs of the leaning post, and therefore the direction of the hinged motion, allows for the forward and aft movement of the leaning post seating and leaning surfaces. Yoke type hinges of the structure shown in FIG. 3 are available in a variety of diameters providing an appropriate size to replace and extend the gap created in the tubular structure of the legs of the typical leaning post. Although alternate hinge structures may be implemented, the overall cylindrical configuration of the yoke type hinge shown in FIG. 3 is preferable due to its continuity with the profile and structure of the cylindrical leg.

Figure 4:
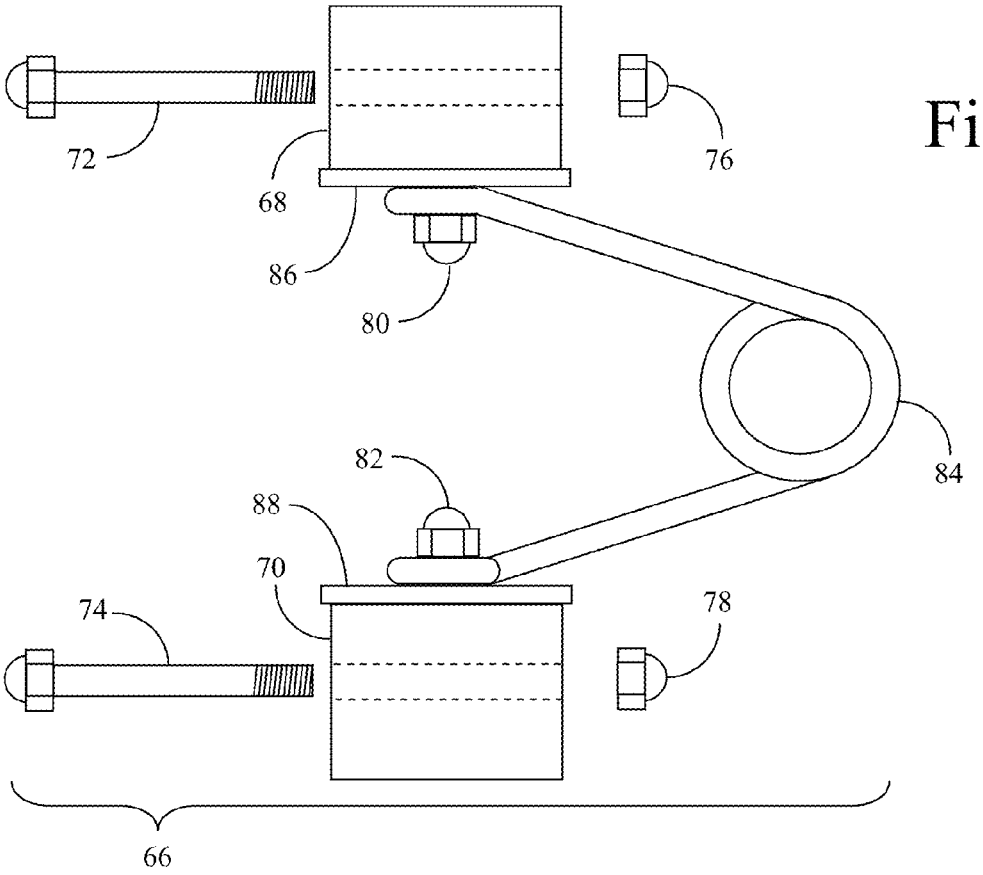
FIG. 4 is an elevational side view of a spring module component of the system of the present invention structured for inclusion in a kit that allows modification of an existing leaning post.
Figure 5:
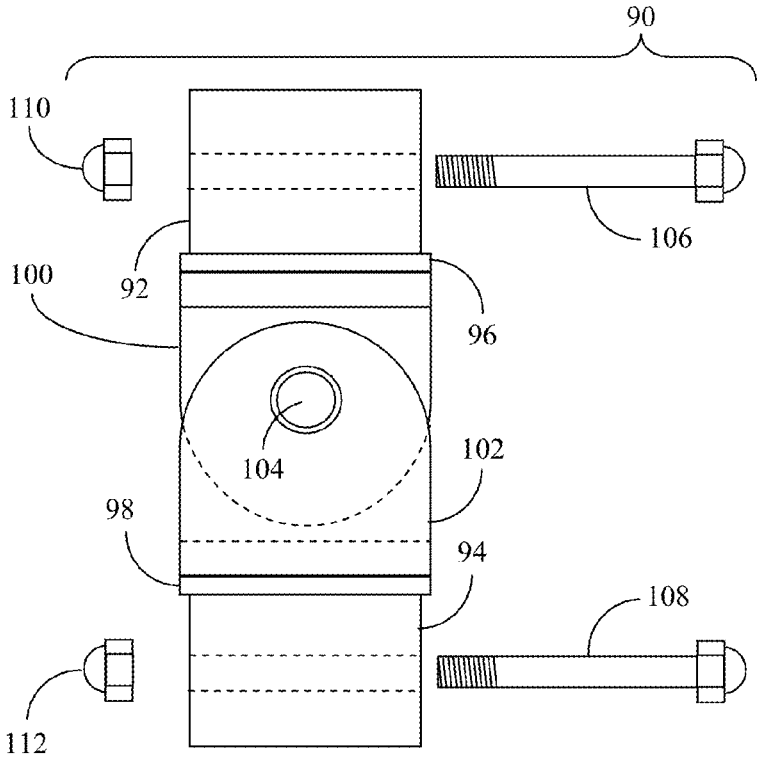
FIG. 5 is an elevational side view of a hinge module component of the system of the present invention structured for inclusion in a kit that allows modification of an existing leaning post.

Reference is next made to FIGS. 4 & 5 for detailed descriptions of alternate structures for the spring modules and hinge modules that may be more appropriate for inclusion in a kit designed to allow a boat owner to modify an existing leaning post. FIG. 4 shows the assembly of components associated with each of two spring modules, again typically positioned on the aft legs of the leaning post. Spring module 66 is shown to generally comprise top mount insert 68 and base mount insert 70 which are, in this embodiment, cylindrical structures sized to match the inside diameter of the tubular legs of the leaning post. By positioning flange washers 86 & 88 on the ends of mount inserts 68 & 70, the combined structures may be inserted into the open tubular ends created in the leg gap during the modification process.

Each mount insert 68 & 70 preferably includes a fixed threaded post (not shown) extending through the corresponding flange washer in a manner that allows for the placement of a bushing (not shown) and the spring end loops onto the inserts as shown. The end loops of the spring may then be secured to the threaded posts using spring cap nuts 80 & 82.

Securing the spring module 66 into the gap created in the legs of the leaning post may be accomplished by using attachment bolts 72 & 74 in combination with attachment cap nuts 76 & 78. Bolts 72 & 74 would extend through holes created (drilled) in the sides of the existing tubular leg structures and through the pre-drilled apertures across the diameters of top mount insert 68 and base mount insert 70, as shown in dashed line form in FIG. 4. Both the attachment bolts and the attachment cap nuts are preferably provided with smooth cap tops in order to prevent any sharp edges of the attachment components from being exposed.

Installation of two spring modules 66 and two hinge modules 90 as included in a kit or the like, would typically involve cutting the legs of the leaning post and/or cutting a predetermined section length of the legs of the leaning post out of the legs, and replacing the removed section with either a spring module 66 or a hinged module 90 as determined by the position of the leg as shown in FIG. 1. In order to maintain the same overall height to the leaning post, it is preferable to cut a section of the legs out to create a gap rather than to simply cut and elevate the leaning post top frame structure. Whether to simply cut the legs of the leaning post or to cut sections out of the leaning post legs may be at the option of the user.

FIG. 5 shows in detail the components of hinge module 90 that are preferably included in a kit suitable for modifying an existing leaning post. Hinge module 90 generally comprises top mount insert 92 and base mount insert 94 structured similar to the corresponding components in spring module 66 shown in FIG. 4. Each mount insert likewise is attached to or formed as an extension of flange washer 96 or flange washer 98, as shown. Top mount insert 92 retains and supports hinge center post 100 and base mount insert 94 retains and supports hinge yoke post 102 (although the opposite orientation would function just as well). Hinge center post 100 and hinge yoke post 102 are hingedly connected together by hinge pin 104 which allows rotational movement around hinge pin 104.

The attachment of hinge module 90 into the gap formed in the forward legs of the leaning post is accomplished in much the same manner as installation of the spring module described above in FIG. 4. Attachment bolts 106 & 108 are inserted through the appropriate apertures created in the existing legs of the leaning post and pre-drilled in the mount inserts 92 & 94 of hinge module 90. Attachment cap nuts 110 & 112 are likewise utilized to secure attachment bolts into place.

It is anticipated that a kit that would include the various components of the present invention as described above would also include appropriate templates for use by the boat owner in modifying the existing leaning post frame structure. These templates would not only provide the appropriate gap size, but also the orientation of the necessary apertures to be drilled and the orientation of the modules themselves within the gaps created by cutting the leaning post legs. Such kits would be sized to accommodate the variety of standard sized round tube (and the occasional square tube) structures most commonly associated with the leg supports for leaning posts. The modules would, of course, be sold in pairs with the typical kit containing two spring modules and two hinge modules.

Figure 6:
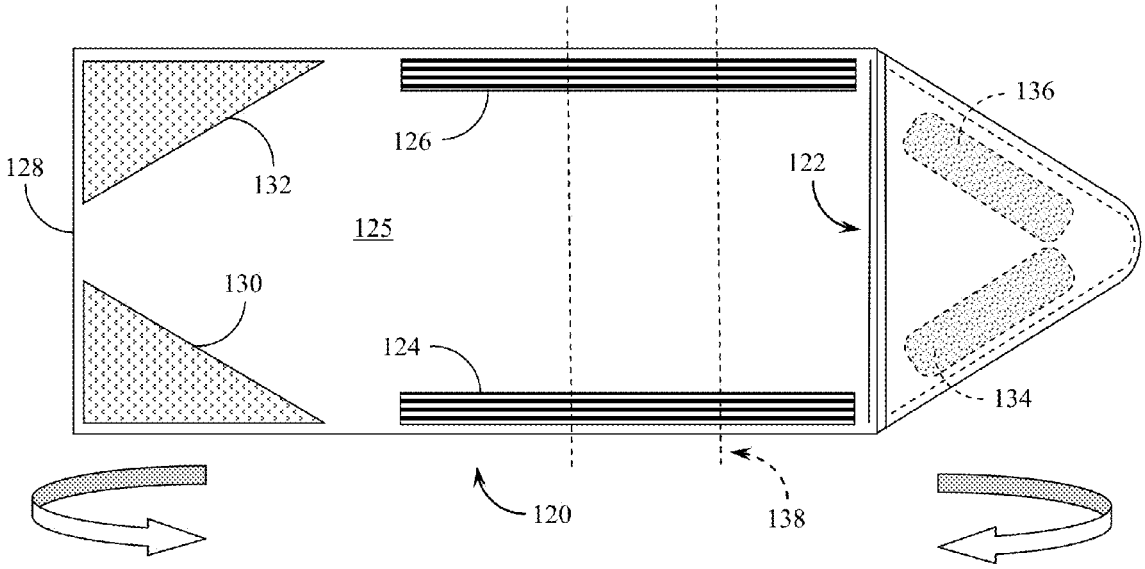
FIG. 6 is an elevational side view of a spring module removable cover for the system of the present invention.
Figure 7:
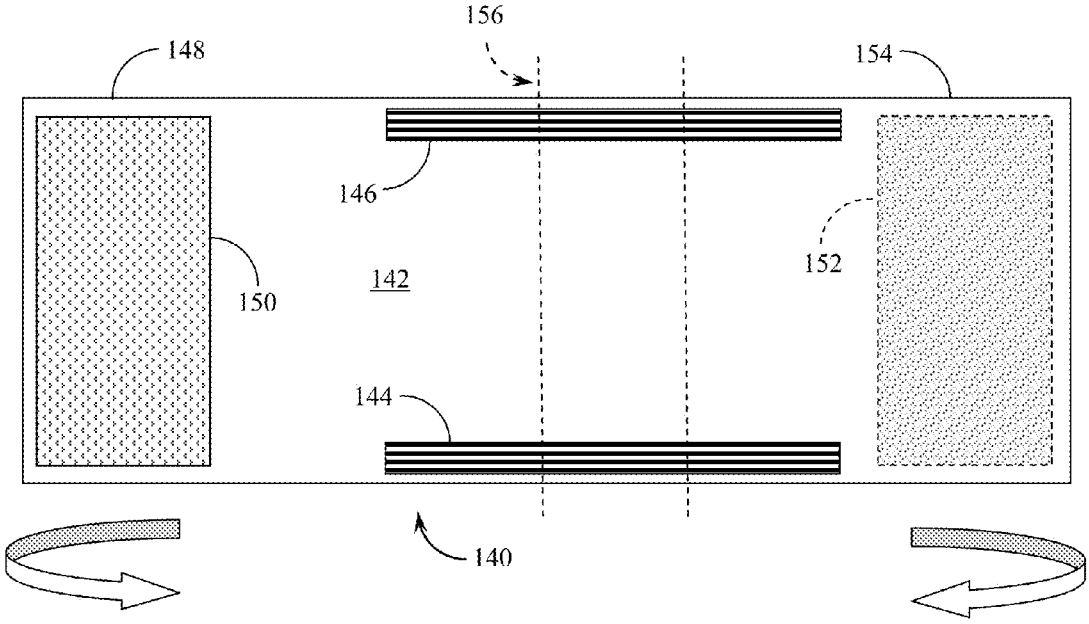
FIG. 7 is an elevational side view of a hinge module removable cover for the system of the present invention.

Reference is finally made to FIGS. 6 & 7 which show optional cover components suitable for wrapping the installed modules of the present invention once in place on the leaning post legs. FIG. 6 provides a spring module cover 120 utilizing hook and loop surfaces 130, 132, 134 & 136, that allow the user to loosely cover and surround the spring components of the present invention with a smooth surfaced flexible cover material 125. The spring pocket 122 may be initially fitted over the spring section that extends out from the leaning post leg with the balance 128 of the cover extending around the gap created in the leg in a loose manner. Elastic material 124 & 126 may be utilized to further secure spring module cover 120 tightly against the external cylindrical surface of the leg structure. Hook and loop material 130 & 132 on the opposite end of the spring cover may then extend over, around, and attach to hook and loop material 134 & 136 on the back side of spring pocket 122 that has already been secured. In this manner, there are no internal sections of the cover that are likely to engage any of the spring components during the motion of the spring and the partial closure of the gap created in the leaning post legs.

FIG. 7 shows a simple, loosely structured cover 140 that is, again, fitted with hook and loop surface 150 on a first end 148 and hook and loop surface 152 on a second end 154 so as to allow the user to wrap the hinge component entirely in order to cover the installation both for appearance and practical purposes. Hinge cover 140 is preferably a rectangular section of flexible material 142, again fitted with elastic components 144 & 146 on the top and bottom in order to assist in securing the cover around the hinge modules positioned on the forward legs of the leaning post.

Although the present invention has been described in conjunction with a number of preferred embodiments, those skilled in the art will recognize modifications to those embodiments that still fall within the spirit and scope of the invention. These modifications may include not only changes in the geometry and/or size of the modular components, but also their structure and orientation. For example, while torsion springs have been described as providing a preferred mechanism for maintaining a resilient gap in the aft legs of the leaning post, alternate spring structures might be utilized. The objective is to create a simple structure that the average boat owner may implement without the need for specialty tools or skills. It may be possible, for example, to substitute a single leaf spring type structure for the helical torsion spring shown in the preferred embodiment. With each of the modules described in the present invention, one objective is to avoid the creation of any protrusions that change the overall profile of the leaning post, preferring instead to extend structures inward rather than outward from the legs of the leaning post.

I claim:

1. A system of components for modifying a watercraft leaning post to provide greater flexibility while maintaining firm support, the watercraft leaning post having one or more forward legs, one or more aft legs, and a top section, the system of components comprising:

(a) one or more spring modules for incorporation into the one or more aft legs of the leaning post; and (b) one or more hinge modules for incorporation into the one or more forward legs;

wherein after installation of the system components, the top section of the leaning post may tilt backwards under pressure from above or from the front of the leaning post, pivoting on the one or more hinge modules and resisted by the one or more spring modules.

2. The system of claim 1 wherein the one or more spring modules each comprise a torsion spring configured to fit within a gap created in each of the one or more aft legs of the leaning post.

3. The system of claim 1 wherein the one or more spring modules each comprise a compression spring configured to fit within a gap created in each of the one or more aft legs of the leaning post.

4. The system of claim 1 wherein the one or more hinge modules each comprise a cylindrical yoke hinge configured to fit within a gap created in each of the one or more forward legs of the leaning post.

5. The system of claim 2 wherein each of the one or more spring modules further comprises a spring top mount and a spring base mount, the torsion spring extending between the spring top mount and the spring base mount, the spring top mount attached to a top portion of an aft leg created by dividing the aft leg into a top portion and a base portion, the spring base mount attached to the base portion of the divided aft leg.

6. The system of claim 5 wherein the one or more aft legs are tubular and each spring top mount and spring base mount comprise an attachment plug fixed into an open end of the top portion and the base portion, respectively, of the divided aft leg.

7. The system of claim 5 wherein each spring top mount and spring base mount comprise an attachment cap fixed over an end of the top portion and the base portion, respectively, of the divided aft leg.

8. The system of claim 3 wherein each of the one or more spring modules further comprises a spring top mount and a spring base mount, the compression spring extending between the spring top mount and the spring base mount, the spring top mount attached to a top portion of an aft leg created by dividing the aft leg into a top portion and a base portion, the spring base mount attached to the base portion of the divided aft leg.

9. The system of claim 8 wherein the one or more aft legs are tubular and each spring top mount and spring base mount comprise an attachment plug fixed into an open end of the top portion and the base portion, respectively, of the divided aft leg.

10. The system of claim 8 wherein each spring top mount and spring base mount comprise an attachment cap fixed over an end of the top portion and the base portion, respectively, of the divided aft leg.

11. The system of claim 4 wherein each of the one or more hinge modules further comprises a hinge top mount and a hinge base mount, the cylindrical yoke hinge extending between the hinge top mount and the hinge base mount, the hinge top mount attached to a top portion of a forward leg created by dividing the forward leg into a top portion and a base portion, the hinge base mount attached to the base portion of the divided forward leg.

12. The system of claim 11 wherein the one or more forward legs are tubular and each hinge top mount and hinge base mount comprise an attachment plug fixed into an open end of the top portion and the base portion, respectively, of the divided forward leg.

13. The system of claim 11 wherein each hinge top mount and hinge base mount comprise an attachment cap fixed over an end of the top portion and the base portion, respectively, of the divided forward leg.

14. The system of claim 1 wherein the one or more aft legs comprise two aft legs and the one or more forward legs comprise two forward legs.

15. The system of claim 5 wherein each of the spring top mounts are secured to the top portion of an aft leg with a bolt passing through the spring top mount and the top portion of the aft leg, and each of the spring base mounts are secured to the base portion of an aft leg with a bolt passing through the spring base mount and the base portion of the aft leg.

16. The system of claim 8 wherein each of the spring top mounts are secured to the top portion of an aft leg with a bolt passing through the spring top mount and the top portion of the aft leg, and each of the spring base mounts are secured to the base portion of an aft leg with a bolt passing through the spring base mount and the base portion of the aft leg.

17. The system of claim 11 wherein each of the hinge top mounts are secured to the top portion of a forward leg with a bolt passing through the hinge top mount and the top portion of the forward leg, and each of the hinge base mounts are secured to the base portion of a forward leg with a bolt passing through the hinge base mount and the base portion of the forward leg.

18. A method for modifying a watercraft leaning post to provide greater flexibility while maintaining firm support, the watercraft leaning post having one or more forward legs, one or more aft legs, and a top section, the method comprising the steps of:

(a) demounting the leaning post from the watercraft;

(b) providing a spring module for each of the one or more aft legs;

(c) providing a hinge module for each of the one or more forward legs;

(d) dividing each of the one or more aft legs and each of the one or more forward legs into top portions and bottom portions, the divided legs thereby each defining a gap between coaxially aligned corresponding top portions and bottom portions;

(e) positioning a spring module in the gap defined by the coaxially aligned top portion and bottom portion of each of the divided aft legs;

(f) positioning a hinge module in the gap defined by the coaxially aligned top portion and bottom portion of each of the divided forward legs; and (g) remounting the leaning post to the watercraft;

wherein after remounting the leaning post, the top section of the leaning post may tilt backwards under pressure from above or from the front of the leaning post, pivoting on the one or more hinge modules and resisted by the one or more spring modules.

19. The method of claim 18 wherein the step of dividing each of the one or more aft legs and each of the one or more forward legs into top portions and bottom portions comprises cutting each of the legs into approximately equal halves.

20. The method of claim 18 wherein the step of positioning a spring module in the gap defined by the coaxially aligned top portion and bottom portion of each of the divided aft legs further comprises drilling holes through gap ends of the top and bottom portions of the divided aft legs and securing the spring module in place with bolts, and the step of positioning a hinge module in the gap defined by the coaxially aligned top portion and bottom portion of each of the divided forward legs further comprises drilling holes through gap ends of the top and bottom portions of the divided forward legs and securing the hinge module in place with bolts.

* * * * *